US009088840B2

(12) United States Patent
Choi et al.

(10) Patent No.: US 9,088,840 B2
(45) Date of Patent: Jul. 21, 2015

(54) VIBRATION MODULE FOR SOUND TRANSDUCER

(71) Applicant: Em-Tech. Co., Ltd., Busan (KR)

(72) Inventors: Kyu Dong Choi, Gyeongsangnam-do (KR); Kil Dong Park, Busan (KR); In Ho Jeong, Gyeongsangnam-do (KR); Joong Hak Kwon, Gyeongsangbuk-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 14/063,605

(22) Filed: Oct. 25, 2013

(65) Prior Publication Data

US 2014/0119578 A1 May 1, 2014

(30) Foreign Application Priority Data

Oct. 29, 2012 (KR) ..... 10-2012-0120484

(51) Int. Cl.

| | |
|---|---|
| ***H04R 1/00*** | (2006.01) |
| ***H04R 7/14*** | (2006.01) |
| ***H04R 31/00*** | (2006.01) |
| ***H04R 9/04*** | (2006.01) |

(52) U.S. Cl.

CPC .. *H04R 1/00* (2013.01); *H04R 7/14* (2013.01); *H04R 9/045* (2013.01); *H04R 31/003* (2013.01)

(58) Field of Classification Search

CPC ..... H04R 2440/00–2440/07; H04R 2217/00–2217/03; H04R 19/00; H04R 19/01; H04R 19/013; H04R 19/016; H04R 9/00; H04R 7/04

USPC ..... 381/182, 190–191, 386, 396, 423–424, 381/431, 162, 398

See application file for complete search history.

(56) References Cited

U.S. PATENT DOCUMENTS

| | | | | |
|---|---|---|---|---|
| 3,509,290 | A * | 4/1970 | Kazukiyo et al. | 381/431 |
| 4,847,908 | A * | 7/1989 | Nieuwendijk et al. | 381/431 |
| 4,924,504 | A * | 5/1990 | Burton | 381/431 |
| 5,693,917 | A * | 12/1997 | Bertagni et al. | 381/431 |
| 6,259,800 | B1 * | 7/2001 | Tagami | 381/431 |
| 6,404,896 | B1 * | 6/2002 | Yoo et al. | 381/431 |
| 8,295,538 | B2 * | 10/2012 | Harris et al. | 381/404 |
| 8,520,885 | B2 * | 8/2013 | Tanabe | 381/396 |

* cited by examiner

*Primary Examiner* — Suhan Ni

(74) *Attorney, Agent, or Firm* — Murphy, Bilak & Homiller, PLLC

(57) ABSTRACT

The present invention relates to a vibration module for a sound transducer and, more particularly, to a vibration module for a sound transducer which can prevent sound leakage by minimizing contacts between a diaphragm and a voice coil. The vibration module for the sound transducer according to the present invention comprises: a substrate having an inner portion and an outer portion, an electrical connection portion for applying electrical signals to a voice coil being provided on the inner portion and a terminal being provided on the outer portion, for performing electrical connection between the electrical connection portion and the terminal; a first diaphragm attached between the inner portion and outer portion of the substrate; and the voice coil mounted on the inside of the inner portion of the substrate with a certain distance from the first diaphragm and electrically connected to the electrical connection portion.

7 Claims, 3 Drawing Sheets

VIBRATION MODULE FOR SOUND TRANSDUCER

TECHNICAL FIELD

The present invention relates to a vibration module for a sound transducer and, more particularly, to a vibration module for a sound transducer which can prevent sound leakage by minimizing contacts between a diaphragm and a voice coil.

BACKGROUND ART

FIG. 1 is a sectional view showing a conventional sound transducer.

As shown, a typical sound transducer (speaker) includes a frame 1, a yoke 2 inserted and mounted inside the frame 1, an inner ring magnet 3 and an outer ring magnet 4 for transmitting a magnetic flux to the yoke 2 or receiving the magnetic flux from the yoke 2, an inner ring top plate 5 and an outer ring top plate 6 for receiving the magnetic flux from the inner ring magnet 3 or the outer ring magnet 4 and transmitting the magnetic flux to a voice coil 7 at a right angle, the voice coil 7 partially inserted into an air gap between the inner ring magnet 3 and inner ring top plate 5 and the outer ring magnet 4 and outer ring top plate 6, a diaphragm 8, into which the voice coil 7 is attached, for generating vibration by the vertical movement of the voice coil 7, and a protector 10 having a sound-emitting hole 11 and protecting the diaphragm 8.

As illustrated in FIG. 1, a lead-out line 12 of the voice coil 7 is fixedly adhered to the bottom face of the diaphragm 8 by a line exchange bond, taken out through the lateral face of the frame 1 or a groove (not shown) formed in the frame 1, and soldered to a terminal 14 along the outer lateral face of the frame 1, respectively. The terminal 14 is used to connect a pair of leads and ears (not shown) and lead-out lines (input and output lines) to one another from the outside.

A process of bonding the lead-out line 12 of the voice coil 7 and the diaphragm 8 is performed as a line exchange bonding process of fixedly bonding the lead-out line 12 to the bottom face of the diaphragm 8 by a line exchange bond. Although high precision is needed, this bonding process is manually carried out, which results in long processing time and high costs. In addition, frequent defects make this process the weakest one among the processes of manufacturing a microspeaker.

Moreover, since the lead-out line 12 is fixed to the diaphragm 8 by the line exchange bond, when electrical signals are converted into acoustic signals through vibration, mass and stiffness distribution of the diaphragm 8 is not uniform, which causes split vibration and degrades acoustic characteristics.

DISCLOSURE OF THE INVENTION

An object of the present invention is to provide a vibration module for a sound transducer which can be adapted to avoid contacts between a diaphragm and a lead-out line of a voice coil.

Another object of the present invention is to provide a vibration module for a sound transducer which can allow a voice coil to be fixed to a relatively less-vibrated portion.

A further object of the present invention is to provide a vibration module for a sound transducer which can reduce the total weight.

According to an aspect of the present invention for achieving the above objects, there is provided a vibration module for a sound transducer, comprising: a substrate having an inner portion and an outer portion, an electrical connection portion for applying electrical signals to a voice coil being provided on the inner portion and a terminal being provided on the outer portion, for performing electrical connection between the electrical connection portion and the terminal; a first diaphragm attached between the inner portion and outer portion of the substrate; and the voice coil mounted on the inside of the inner portion of the substrate with a certain distance from the first diaphragm and electrically connected to the electrical connection portion.

In addition, preferably, the inner portion is formed around a perforation of the substrate, and a second diaphragm is attached to the inner portion of the substrate.

Moreover, preferably, a extension portion with the electrical connection portion formed thereon is provided on the inside of the inner portion of the substrate.

Further, preferably, a guide portion for guiding a lead-out line of the voice coil from the bottom face of the voice coil to the electrical connection portion is disposed on the inner portion of the substrate, to which the voice coil is attached.

Furthermore, preferably, the guide portion is a through hole or a groove.

Still furthermore, preferably, the second diaphragm covers the through hole.

Still furthermore, preferably, the second diaphragm includes a seating portion, which is attached to the extension portion, and includes, on the inside, a plurality of dome portions, which are raised in opposite directions.

Still furthermore, preferably, the first diaphragm and the second diaphragm are attached to the opposite faces of the substrate, respectively.

Still furthermore, preferably, the substrate performs a suspension action for holding vibration of the diaphragm.

The vibration module for the sound transducer according to the present invention can prevent split vibration by achieving uniform mass and stiffness distribution by avoiding contacts between the diaphragm and the lead-out line of the voice coil.

In addition, the vibration module for the sound transducer according to the present invention can simplify the process and improve product reliability by allowing the voice coil to be fixed to the relatively less-vibrated portion.

Moreover, the vibration module for the sound transducer according to the present invention can reduce the total weight.

Figure 1:
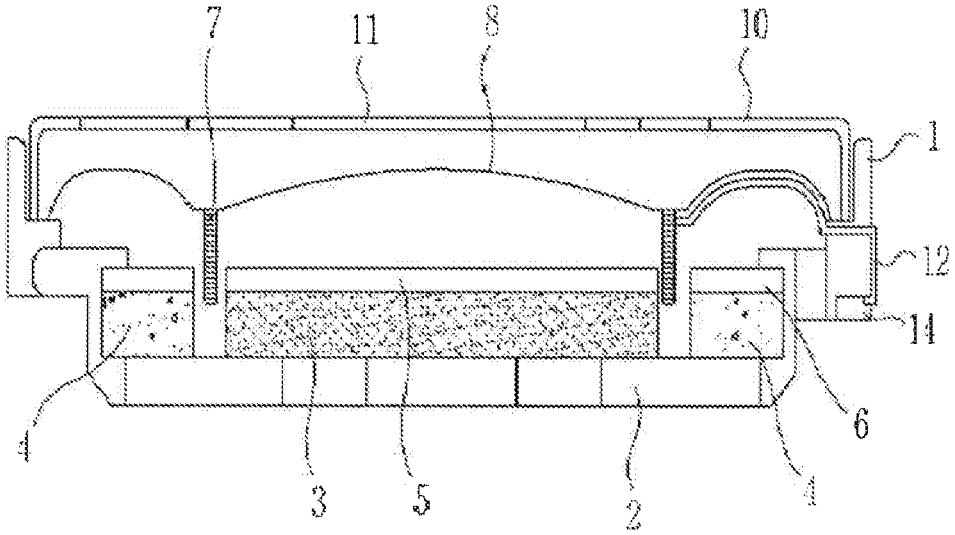
FIG. 1 Prior Art
FIG. 1 is a sectional view showing a conventional sound transducer.

| <Reference numerals of Major portions of the Drawings> | |
|---|---|
| 20: Voice coil | 30: Side diaphragm |
| 40: Substrate | 50: Center diaphragm |

BEST MODE FOR CARRYING OUT THE INVENTION

Hereinafter, the present invention will be described in more detail with reference to the drawings and exemplary embodiments.

Figure 2:
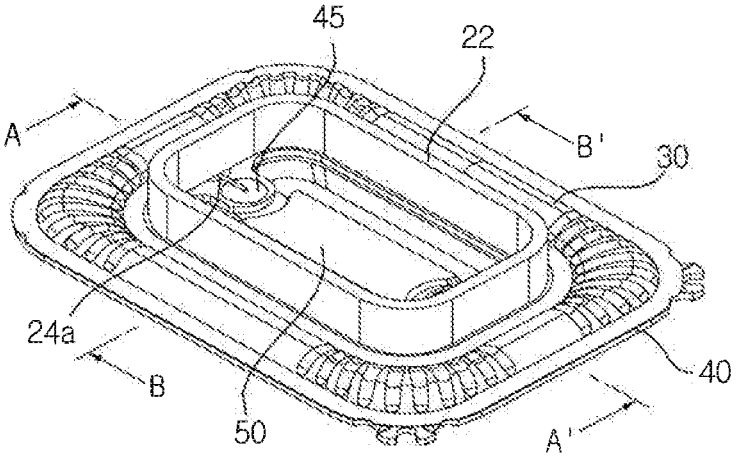
FIG. 2 is a perspective view showing a vibration module for a sound transducer according to the present invention.
Figure 3:
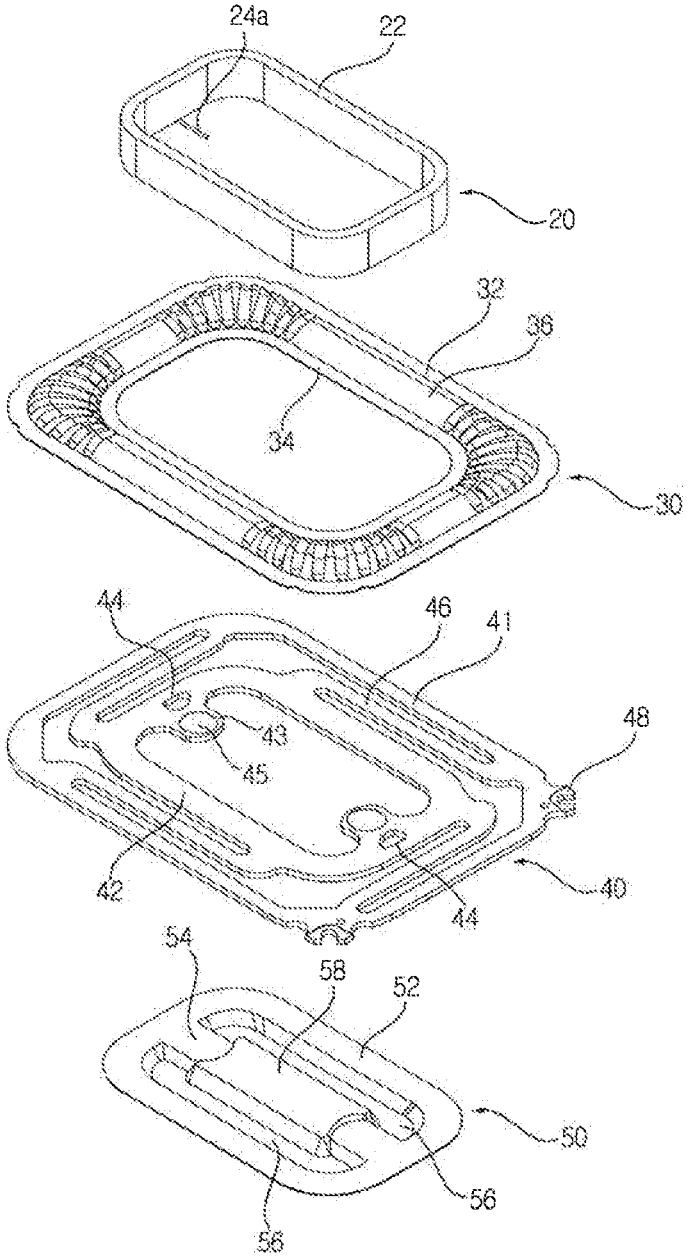
FIG. 3 is an exploded perspective view of FIG. 2.
Figure 4:
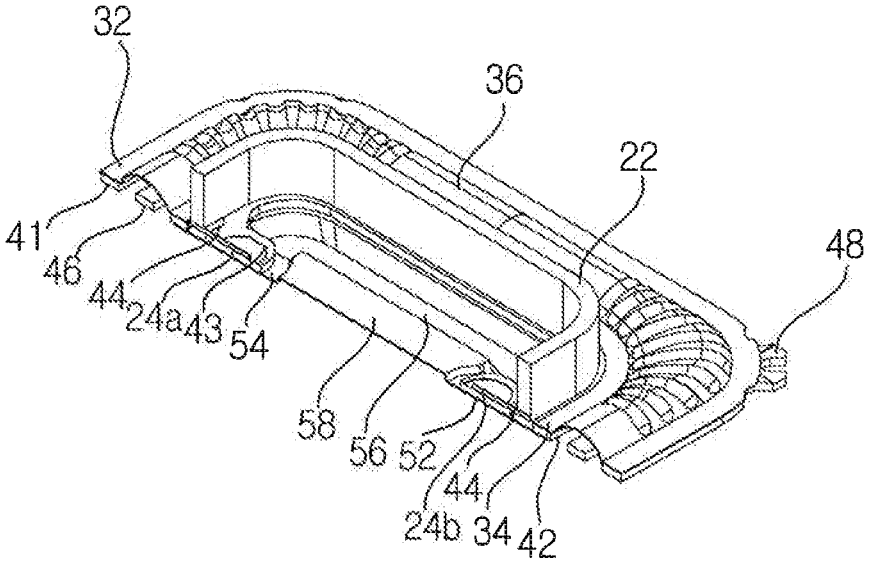
FIG. 4 is a sectional perspective view taken along line A-A' of FIG. 2.
Figure 5:
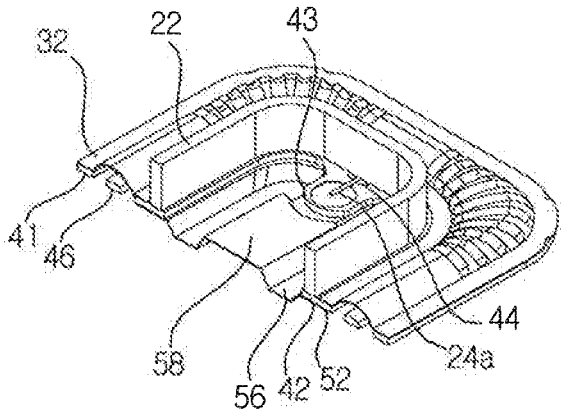
FIG. 5 is a partial sectional perspective view taken along line B-B' of FIG. 2.

FIG. 2 is a perspective view showing a vibration module for a sound transducer according to the present invention, FIG. 3 is an exploded perspective view of FIG. 2, FIG. 4 is a sectional perspective view taken along line A-A' of FIG. 2, and FIG. 5 is a partial sectional perspective view taken along line B-B' of FIG. 2.

The vibration module includes a voice coil 20 for receiving electrical signals, a diaphragm comprised of a perforated side diaphragm 30, which is formed in a ring shape, and a center diaphragm 50, and a substrate 40 (e.g., FPCB substrate) transferring electrical signals to the voice coil 20 and electrically connected to a terminal 48 for receiving electrical signals from an external terminal and a suspension for holding vibration of the diaphragm.

The voice coil 20 includes a first lead-out line 24*a* and a second lead-out line 24*b*, which are electrically connected to a pair of terminals 48, and a coil main body 22, which is formed by winding up the coil.

The side diaphragm 30 includes an outer peripheral portion 32 attached to a lateral seating portion 41 of the substrate 40, an inner peripheral portion 34 formed around a perforation and attached to a central seating portion 42, and a dome connecting portion 36 formed in a dome shape to connect the outer peripheral portion 32 to the inner peripheral portion 34.

The substrate 40 includes the lateral seating portion 41 to which the outer peripheral portion 32 of the side diaphragm 30 is attached, the central seating portion 42 to which the inner peripheral portion 34 of the side diaphragm 30, the voice coil 20 and the center diaphragm 50 are attached, a extension portion 43 which projects inwardly from the substrate, a through hole 44 which allows the lead-out lines 24*a* and 24*b* to run downwardly from the coil main body 22, an electrical connection portion 45 disposed on the extension portion 43, a connecting portion 46 connecting the lateral seating portion 41 to the central seating portion 42 and giving damping effects, and the terminal 48 which allows electrical connection to external equipment. Additionally, the substrate 40 transfers electrical signals to the voice coil 20 through a conductive pattern (not shown), the conductive pattern is connected from the terminal 48 to the central seating portion 42 via the lateral seating portion 41 and the connecting portion 46, and then electrically connected to the lead-out lines 24*a* and 24*b* of the voice coil 20 at the electrical connection portion 45, which is disposed on the extension portion 43 of the central seating portion 42, by means of soldering, etc.

The connecting portion 46 allows the diaphragm to vibrate only in the vertical direction, thus preventing abnormal vibration such as split vibration or lateral vibration and improving quality of sound.

The center diaphragm 50 includes an outer peripheral portion 52 attached to the rear face of the central seating portion 42 of the substrate 40, an inner seating portion 54 at least partially attached to the extension portion 43 of the substrate 40, a pair of first dome portions 56 provided on the inside of the outer peripheral portion 52, and a second dome portion 58 provided between the pair of first dome portions 56. An inner seating portion 54 is connected to both ends of the second dome portion 58. The second dome portion 58 is shorter than the first dome portion 56, and the inner seating portion 54 has a length equivalent to the shortened distance. Additionally, the first dome portion 56 and the second dome potion 58 are raised in opposite directions.

The center diaphragm 50 and the side diaphragm 30 may have different stiffness. While the center diaphragm 50 is made of a light-weighted rigid material, the side diaphragm 30 is made of a light-weighted flexible material.

Further, the second dome portion 58 of the center diaphragm 50 is formed higher than the inner seating portion 54, and the first dome portion 56 is formed lower than the inner seating portion 54, which can structurally increase stiffness of the center diaphragm 50. Furthermore, since the second dome portion 58 is formed higher, when the center diaphragm 50 is attached to the rear face of the central seating portion 42, the second dome portion 58 can serve as a guide for locating the center diaphragm 50. Still furthermore, since the first dome portion 56 is formed lower than the inner seating portion 54, when the top face of the inner seating portion 54 is attached to the rear face of the central seating portion 42 and the extension portion 43 by an adhesive, the residual adhesive flows down to the first dome portion 56, and thus is not leaked out of the center diaphragm 50.

The lateral seating portion 41 of the substrate 40 is fixedly mounted on a frame of the sound transducer, thus composing a vibration module of the sound transducer. In composing the sound transducer, the coil main body 22 of the voice coil 20 should be mounted to be included in a magnetic circuit of the sound transducer.

Meanwhile, the substrate 40 has a perforation and the central seating portion 42 is formed around the perforation, so that the total weight of the substrate 40 can be reduced. However, since the center diaphragm 50 is attached to the central seating portion 42, stiffness can be maintained.

The outer peripheral portion 32 of the side diaphragm 30 is attached to the lateral seating portion 41 of the substrate 40, the inner peripheral portion 34 of the side diaphragm 30 is attached to the central seating portion 42 of the substrate 40, and the voice coil 20 is attached to the central seating portion 42, with a certain distance from the inner peripheral portion 34. The terminal 48 of the substrate 40 is exposed to the outside even when the side diaphragm 30 is attached to the substrate 40.

The connecting structure of the voice coil 20 and the substrate 40 will be described below. In manufacturing the voice coil 20, in this embodiment, when the coil is wound up, the lead-out line 24*a* is positioned outside the coil main body 22, and the lead-out line 24*b* is positioned inside the coil main body 22. Thus, as illustrated in FIG. 5, when the lead-out line 24*b* is attached to the electrical connection portion 45, it can be attached to the electrical connection portion 45 without passing under the coil main body 22. However, when the lead-out line 24*a*) is attached to the electrical connection portion 45, it should pass under the coil main body 22 to be attached to the electrical connection portion 45.

Referring to FIG. 4, according to the present invention, the through hole 44 is formed in the central seating portion 42 on the bottom side of the coil main body 22 where the lead-out lines 24*a* and 24*b* are positioned, so that the lead-out line 24*a* can be attached to the electrical connection portion 45 through the through hole 44 under the coil main body 22 without separating the coil main body 22 from the substrate 40. In other words, the bottom face of the coil main body 22 can be uniformly attached to the substrate 40 (i.e., the central seating portion 42) without a gap.

As a result, the lead-out lines 24*a* and 24*b* and the substrate 40 is electrically connected at the extension portion 43 inside the central seating portion 42, rather than the connecting portion 46 which serves as a suspension. It makes it possible to prevent separate vibrations of the electrical connection portion 45 and the lead-out lines 24*a* and 24*b* during high-frequency vibration of the sound transducer.

Moreover, the coil main body 22 is seated on the top face of the through hole 44, and the top face of the inner seating portion 54 of the center diaphragm 50 is attached on the bottom face thereof, thus covering the through hole 44 and preventing sound leakage.

In this embodiment, the through hole 44 is formed in part of the central seating portion 42. However, a concave groove may be formed in the central seating portion 42 by a depth less than the thickness of the central seating portion 42. In this sense, the through hole 44 or groove serves as a kind of guide portion which guides the lead-out lines 24*a* and 24*b* downwardly from the coil main body 22.

In addition, as shown, the side diaphragm 30 and the voice coil 20 are mounted on one side of the substrate 40 with a certain interval apart, the center diaphragm 50 is mounted on the other side of the substrate 40, and the lead-out lines 24*a* and 24*b* are guided to the electrical connection portion 45 through the guide portion disposed on the substrate 40, so that the lead-out lines 24*a* and 24*b* are not brought into contact with the diaphragm.

Moreover, in this embodiment, the inner peripheral portion 34 is formed around a perforation of the substrate 40, but the inner peripheral portion 34 may be solid and the center diaphragm 50 may be omitted.

Additionally, in this embodiment, the side diaphragm 30 and the center diaphragm 50 are attached to the opposite faces of the substrate 40, but may be attached on the same face thereof.

Further, in this embodiment, the electrical connection portion 45 is disposed on the voice coil 20-attached face, but may be disposed on the opposite face. Here, the lead-out lines 24*a* and 24*b* can be electrically connected to the electrical connection portion on the opposite face of the extension portion 43 through the through hole 44.

While the present invention has been illustrated and described in connection with the accompanying drawings and the preferred embodiments, the present invention is not limited thereto and is defined by the appended claims. Therefore, it will be understood by those skilled in the art that various modifications and changes can be made thereto without departing from the spirit and scope of the invention defined by the appended claims.

What is claimed is:

1. A vibration module for a sound transducer, comprising:

a substrate having an inner portion, an outer portion and a connecting portion, an electrical connection portion for applying electrical signals to a voice coil being provided on the inner portion and a terminal being provided on the outer portion, for performing electrical connection between the electrical connection portion and the terminal; and a first diaphragm having an outer peripheral portion attached to the outer portion of the substrate and an inner peripheral portion attached to inner portion of the substrate, and wherein the voice coil is mounted on the inner portion of the substrate with a certain distance from the first diaphragm and electrically connected to the electrical connection portion, wherein a guide portion for guiding a lead-out line of the voice coil from the bottom face of the voice coil to the electrical connection portion is disposed on the inner portion of the substrate, to which the voice coil is attached, wherein the guide portion is a through hole or a groove.

2. The vibration module as claimed in claim 1, wherein the inner portion is formed around a perforation of the substrate, and a second diaphragm is attached over the inner portion of the substrate.

3. The vibration module as claimed in claim 2, wherein the first diaphragm and the second diaphragm are attached to the opposite faces of the substrate, respectively.

4. The vibration module as claimed in claim 2, wherein an extension portion with the electrical connection portion formed thereon is provided on the inside of the inner portion of the substrate.

5. The vibration module as claimed in claim 1, wherein the second diaphragm covers the through hole.

6. The vibration module as claimed in claim 1, wherein the second diaphragm comprises a seating portion, which is attached to the extension portion, and comprises, on the inside, a plurality of dome portions, which are raised in opposite directions.

7. The vibration module as claimed in claim 1, wherein the substrate performs a suspension action for holding vibration of the diaphragm.

* * * * *